United States Patent [19]

Reiche et al.

[11] Patent Number: 4,755,655

[45] Date of Patent: Jul. 5, 1988

[54] THERMAL PROTECTION ARRANGEMENT FOR SOLID DISK GLASS COOKTOP

[75] Inventors: John C. Reiche, Louisville, Ky.; Royce W. Hunt, Jeffersonville, Ind.; W. S. Dominic Ng, Kitchener, Canada

[73] Assignee: General Electric Company, Louisville, Ky.

[21] Appl. No.: 937,994

[22] Filed: Dec. 4, 1986

[51] Int. Cl.[4] ..... H05B 3/68

[52] U.S. Cl. ..... 219/449; 219/458; 219/451; 219/464; 219/445

[58] Field of Search ..... 219/449, 443, 453, 457, 219/458, 459, 460, 461, 462, 463, 464, 467, 446, 448, 450, 451, 452, 466

[56] References Cited

U.S. PATENT DOCUMENTS

| | | | |
|---|---|---|---|
| 3,612,826 | 10/1971 | Deaton | 219/453 |
| 3,622,754 | 11/1971 | Hurko | 219/462 |
| 3,624,352 | 11/1971 | Deaton et al. | 219/449 |
| 4,122,330 | 10/1978 | Fischer et al. | 219/449 |
| 4,350,875 | 9/1982 | McWilliams | 219/449 |
| 4,388,520 | 6/1983 | McWilliams | 219/464 |
| 4,394,564 | 7/1983 | Dills | 219/449 |
| 4,491,722 | 1/1985 | Fischer et al. | 219/458 |
| 4,554,438 | 11/1985 | Schreder | 219/449 |
| 4,680,452 | 7/1987 | Fischer et al. | 219/449 |

FOREIGN PATENT DOCUMENTS 2747652 4/1983 Fed. Rep. of Germany .

*Primary Examiner*—A. D. Pellinen
*Assistant Examiner*—H. L. Williams
*Attorney, Agent, or Firm*—H. Neil Houser; Radford M. Reams

[57] ABSTRACT

A solid disk surface unit mounted in a glass or ceramic support surface, comprising a plate member of cast material with one or more resistive heating elements mounted to the underside thereof and a thermally conductive cover member enclosing the underside of the plate member with its peripheral edge in close thermal contact with the plate member near its periphery, is provided with a thermally responsive switching device thermally coupled to the cover member and adapted to respond to the surface temperature of the cover member at a point relatively remote from its peripheral edge. The switching device is operative to remove power from the resistive heating elements of the surface unit when the sensed cover member temperature exceeds a predetermined threshold temperature, thereby protecting the glass support surface from damage due to thermal stresses resulting from hot spots occurring near the periphery of the surface of the plate member.

16 Claims, 2 Drawing Sheets

FIG. 1
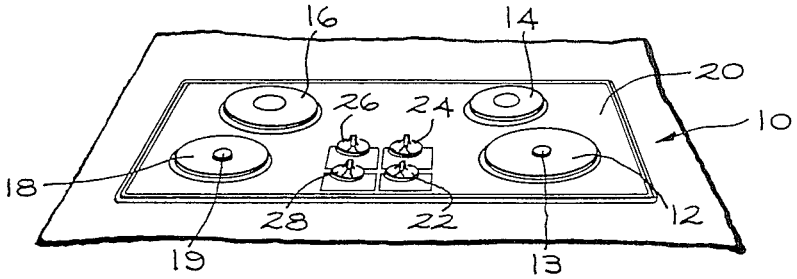
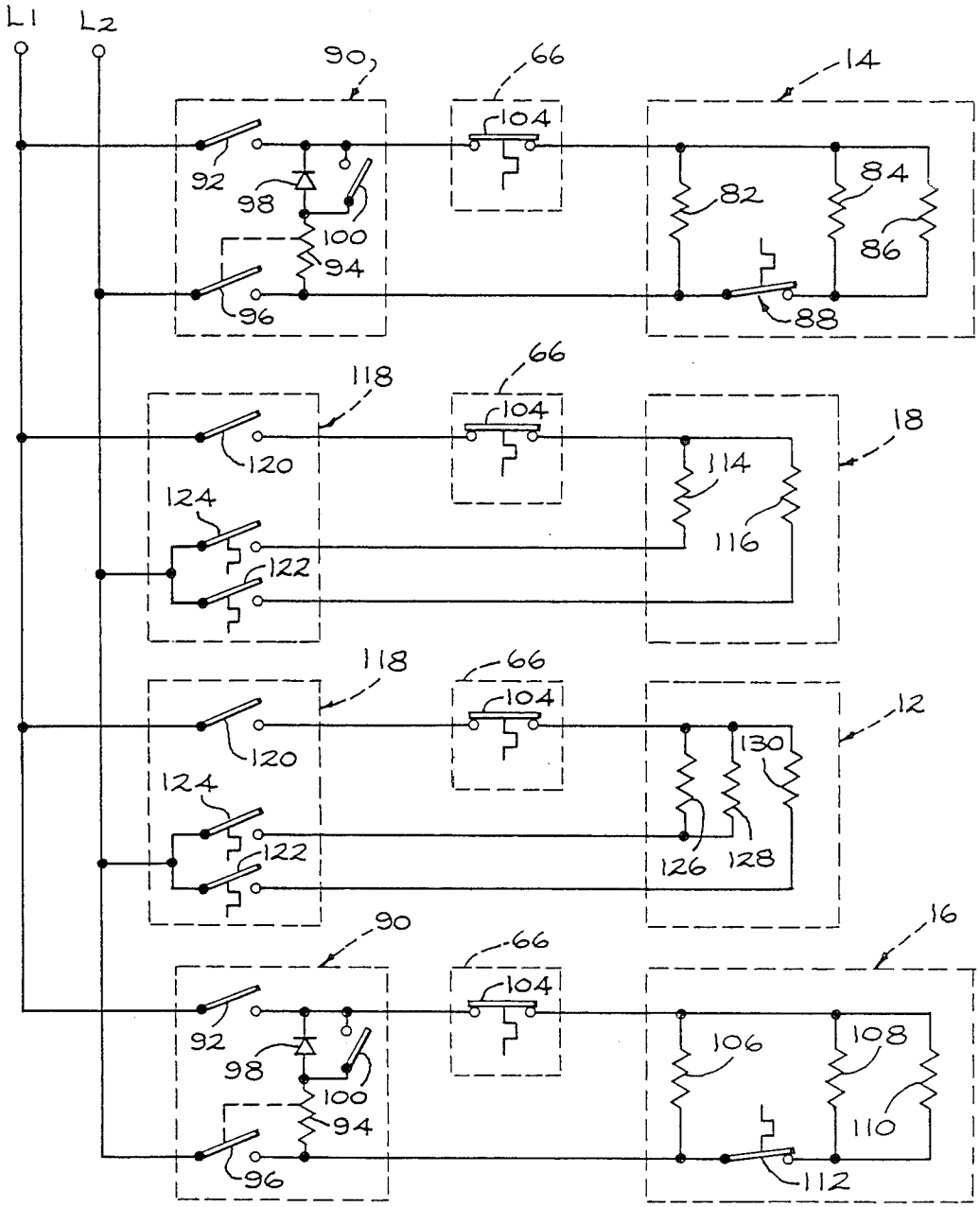
FIG. 4

THERMAL PROTECTION ARRANGEMENT FOR SOLID DISK GLASS COOKTOP

BACKGROUND OF THE INVENTION

This invention relates generally to solid disk surface unit assemblies for mounting in cooktops having a glass or ceramic support surface and in particular to an improved thermal protection arrangement for such assemblies.

Cooktops and ranges featuring solid disk surface units of cast metal material mounted in a sheet metal support surface have been popular for many years particularly in Canada and Europe. In recent years cooktops featuring solid disk surface units mounted in a tempered glass support surface have been introduced to the market place in this country. An arrangement for mounting conventional solid disk surface units in a glass or ceramic support surface is described in U.S. Pat. No. 4,491,722 to Fischer et al.

As described in U.S. Pat. No. 4,122,330 to Fischer, conventional solid disk units may be provided with switching devices which are directly responsive to the temperature of the cast iron heating surface of the surface unit and operative to interrupt energization of one or more of the heating elements in the unit to prevent the unit from becoming hot enough to cause warpage of the unit or of pans supported on the unit. Set point temperatures on the order of 900° F. are typical for such switches. Since a loaded pan placed on a surface unit acts as a heat sink at the contact points, temperatures high enough to damage the cast metal surface units are likely to occur only when the unit is operating at its maximum power setting with either no pan or an empty pan on the unit. Use of thermal limit switches responsive to the temperature of the heating surface in the manner described works satisfactorily in such extreme conditions to prevent damage to the disk itself. In appliances in which the units are supported from a sheet metal support surface, protection against such extreme operating conditions is sufficient. Furthermore, with good pans, that is, pans that provide good uniform surface contact across the entire heating area of the solid disk surface unit, such an arrangement is adequate even with a glass support surface. However, pans, particularly relatively inexpensive pans, tend to become warped with extensive use and warped pans permit air gaps to exist between the pan and the cast iron heating surface. When such gaps exist the heat is not conducted away from the exposed portions of the surface unit and localized hot spots result. The temperature of the glass cooktop surface in the vicinity of such a hot spot may rise to a temperature near or even exceeding the annealing temperature for the glass. When such conditions exist, internal stresses are created in the glass in the vicinity of the hot spot. Repeated cycling of such conditions eventually causes glass fatigue resulting in a shattering of the glass. Due to the localized nature of such hot spots, the temperature of the regions of the surface unit in good contact with the pan may remain well within acceptable temperature limits. Thus, hot spot conditions sufficient to cause such damage may go undetected by the protective arrangement above described unless the hot spot happens to occur in the immediate vicinity of the internal switch sensor.

Hence, there is a need for a protective arrangement for cooktops featuring solid disk surface units mounted in glass support surface, which can respond to hot spots occurring anywhere around the periphery of the surface unit and interrupt the power to the surface unit before the temperature of the glass in the vicinity of the hot spot rises to a level sufficient to damage the glass.

It is therefore an object of the present invention to provide a thermal protection arrangement for a solid disk surface unit mounted in a glass support surface which responds to the occurrence of hot spots anywhere around the periphery of the disk and reduces the power to the surface unit before the temperature of the glass in the vicinity of the disk rises to a level sufficient to cause damage to the glass, without interfering with normal operation of the surface unit.

It is a further object of the present invention to provide a thermal protection arrangement of the aforementioned type which can be incorporated in present solid disk surface unit asemblies at low cost with only minor changes to the mounting structure and circuitry.

SUMMARY OF THE INVENTION

A protective arrangement is provided for a cooking appliance of the type having solid disk surface units mounted in a glass or ceramic support surface which responds to the occurrence of abnormally high temperature conditions anywhere on the periphery of the disk by reducing power to the element to prevent the temperature at the periphery of the disk from rising to a level at which damage to the glass support surface could occur.

In accordance with the broader aspects of the present invention, a solid disk surface unit comprising a plate member of cast material with one or more resistive elements mounted to the underside thereof and a thermally conductive cover member enclosing the underside of the plate member with its peripheral edge in close thermal contact with the plate member near its periphery, is provided with means thermally coupled to the cover member to respond to the surface temperature of the cover member at a point relatively remote from its peripheral edge. This means is operative to disconnect the resistive heating element of the surface unit from the power supply when the sensed cover temperature exceeds a predetermined threshold temperature thereby protecting the glass support surface from damage resulting from hot spots occurring around the periphery of the surface unit. The threshold temperature is selected so as to limit the temperature at the periphery of the surface unit to a temperature less than the annealing temperature of the glass support surface, but is greater than the maximum temperature associated with the maximum normal operating conditions of the surface unit so as not to interfere with normal cooking operations.

In a preferred form of the invention the thermally responsive means comprises a thermally conductive tab member having one end in close thermal contact with the cover member at a location relatively remote from the peripheral edges of the cover member and its other end in close thermal contact with a temperature limit switch. The width and thickness of the tab member and the trip point of the limit switch are selected to cause the switch to trip when the sensed cover temperature exceeds the predetermined threshold temperature.

In accordance with another aspect of the invention, it has been found that this improved thermal protection arrangement for the surface unit can be implemented with only minor changes to the mounting arrangement and circuitry for a conventional solid disk surface unit by mounting the limit switch to the retainer bracket which holds the surface unit in place in the support surface with a tab member extending from the limit switch to an appropriate contact point on the surface unit cover member. The contacts of the limit switch are simply serially connected in the power line.

BRIEF DESCRIPTION OF THE DRAWINGS

While the novel features of the invention are set forth with particularity in the appended claims, the invention both as to organization and content will be better understood and appreciated along with other objects and features thereof from the following detailed description taken in conjunction with the drawings in which:

FIG. 1 is a front perspective view of a portion of a cooktop illustratively embodying the present invention;

FIG. 4 is a simplified schematic circuit diagram of the power control circuit for the cooktop of FIG. 1.

DETAILED DESCRIPTION OF THE ILLUSTRATIVE EMBODIMENT

Figure 2:
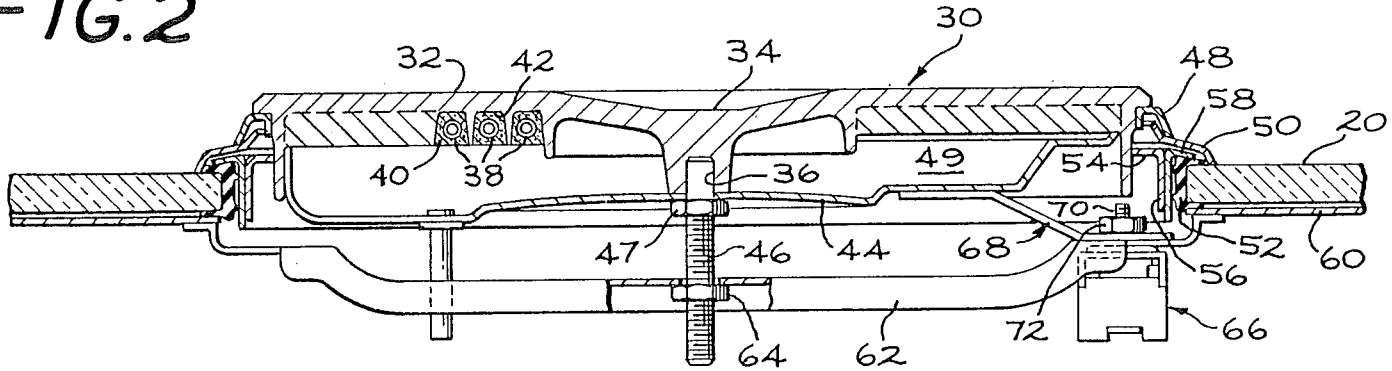
FIG. 2 is a sectional side view of a portion of the cooktop of FIG. 1 showing details of one of the surface units thereof.

FIG. 1 illustrates an electric cooktop 10 incorporating a thermal protection arrangement illustratively embodying the present invention. Cooktop 10 includes four solid disk electric surface units 12, 14, 16 and 18 supported from a tempered glass cooktop support surface 20. Each of these surface units 12–18 are adapted to support cooking utensils such as frying pans, sauce pans, teakettles, etc. placed thereon for heating. Manually operable rotary control knobs 22, 24, 26 and 28 are mounted to support surface 20 enabling the user to select the desired operational setting for surface units 12, 14, 16 and 18 respectively. The overall support structure for the cooktop is described in greater detail in U.S. Pat. No. 4,608,962 to Dominic Ng, the specification of which is hereby incorporated by reference.

Surface units 12 and 16 are 8 inch, 2000 watt units and units 14 and 18 are 6 inch, 1500 watt units, all of which are manufactured by E.G.O. Elektro-Geratebau GmbH and commercially available through E.G.O. Products, Inc. Power to units 14 and 16 is controlled by infinite heat switches set to the desired power level by user manipulation of control knobs 24 and 26 respectively. Units 12 and 18 are automatic surface units. Power to these units is controlled in accordance with the utensil temperature sensed by sensors 13 and 19 for units 12 and 18 respectively, and the temperature selected by the user by manipulation of control knobs 22 and 28 respectively.

The description of the surface unit structure and mounting arrangement to follow is limited to surface unit 14, which is representative of all four units in all respects essential to an understanding of the protective arrangement of the present invention. Referring to FIG. 2 showing a cross-sectional view of the surface unit 14 of FIG. 1, surface unit 14 comprises a cast iron plate member 30 having a flat upper heating surface 32 and a relatively depressed unheated central zone 34, the underside of which has extending downwardly therefrom a threaded socket 36. The heating surface is heated by spiral resistive heating conductors 38 which are received in an embedding material 40 in spiral grooves 42 on the underside of plate meaber 30. The underside of plate 30 is covered by thermally conductive cover member 44 manufactured from pressed sheet metal which is pressed into close thermal contact at its periphery with the underside of the plate member 30 near its periphery. Cover member 44 is retained in this position by nut 47 mounted on threaded central stud 46 which is received in threaded socket 36, and projects through a central opening in cover member 44. The area enclosed between cover member 44 and plate 30 forms dead air space 49.

Plate member 30 is supported from glass cooktop support surface 20 by a mounting assembly comprising sheet metal support ring 48, intermediate ring 50, seal member 52 and insert ring 54. Support ring 48 at its outer rim rests on intermediate ring 50. The outer rim of intermediate ring 50 rests on glass support member 20. Seal member 52 made of heat resistant plastic surrounds the opening formed in support surface 20 and is supported therefrom to receive the surface unit assembly. Insert ring 54 is of substantially L-shaped cross-sectional configuration with a cylindrical shielding portion 56 and an outer flange 58 which is slightly downwardly chamfered in conformance with the upper edge of seal 52 on which it rests. Ring 54 shields seal 52 against direct thermal radiation as well as from the hot plate and also from the inner area of support ring 48.

A plate-like sub-structure 60 extends beneath glass plate 20 for structural support. Bracket member 62, comprising an inverted U-shaped channel member, extends beneath surface unit 14, spanning the opening in the glass 20 and support sub-structure 60 for receiving the surface unit, with the ends of bracket member 62 abutting the inner face of substructure 60 near the periphery of the surface unit opening. Bracket member 62 is secured to plate 30 by threaded stud member 46 so that tightening of the nut 64 tightens the ends of bracket member 62 against the inner face of sub-structure 60 thereby clamping the surface unit in position.

During normal operation with good flat pans; that is pans that make good continuous contact across the entire flat portion of the surface unit, the pan and its contents serve as a heat sink to efficiently conduct heat away from the surface unit and prevent a surface unit from exceeding normal operating temperature limits. However, if a unit is turned on full power and left uncovered, or left with an empty utensil as might happen should the contents boil dry, the temperature of plate 30 could rise sufficiently to warp the surface unit itself, as well as the utensil supported on the plate. To prevent such damage surface units 14 and 16 are provided with an internal limit switch (not shown) which is mounted in dead air space 49 between cover member 44 and the underside of plate 30. As will be hereinafter described with respect to the power circuit, this limit switch operates to disconnect two of the three resistive elements, thereby limiting the maximum temperature that the surface unit can reach to a safe level. The limit switch responds directly to the temperature of the underside of plate 30. lypically this limit switch is set at a threshold temperature of approximately 900° F.

As mentioned briefly in the Background discussion, when the surface unit is operated without a utensil or with a good flat utensil that is empty, an undesirably high temperature may be reached but that temperature will be substantially uniformly distributed across the entire heating surface of the surface unit. Hence, the internal limit switch will detect and respond to such conditions. However, in the case of uneven or warped pans which make good contact over a substantial portion of the element but have a dead air space between the utensil and the element over a relatively small portion of the surface of the surface unit, the temperature of the unit in vicinity of the air gap will greatly exceed the temperature of the portions of the element in good contact with the utensil. Consequently, unless the resulting hot spot tends to occur in the vicinity of the limit switch, which would be strictly a chance occurrence, the internal limit switch would not respond to this condition, with the result that the glass in the region nearest the hot spot may be heated to above its annealing temperature overstressing the glass and resulting in breakage of the support surface.

Surface units 12 and 18 are automatic surface units equipped with temperature sensors for sensing the temperature of utensils being heated and energization of these units is controlled as a function of the sensed utensil temperature to maintain the temperature near the temperature selected by user manipulation of control knobs 22 and 28 respectively. Such units are not provided with an internal limit switch, relying instead on the utensil temperature sensor to prevent overheating. However, the localized nature of hot spots resulting from use of warped pans also precludes the temperature sensor from providing adequate protection for the glass.

Protection for both types of units against such damage is provided in accordance with the present invention by use of means responsive to the surface temperature of the outside surface of bottom cover 44 and operative to decouple power to the surface unit when the temperature of the cover member exceeds a predetermined threshold temperature.

It will be recalled that cover member 44 is a good thermal conductor, which is mounted in good thermal contact with substantially the entire periphery of plate member 30. It has been empirically determined that there is sufficient correlation between the cover outer surface temperature and the temperature about the periphery of the disk to render the temperature at a contact point on the outer surface of the cover member a reliable indicator of a hot spot occurring anywhere around the periphery of the disk, provided that the contact point is located sufficiently radially inwardly from the periphery to avoid excessive biasing by the temperature at the edge of the disk nearest the contact point. The region of the cover surface generally intermediate the center and the periphery has been found to be sufficiently remote from the periphery to meet this requirement.

Figure 3A:
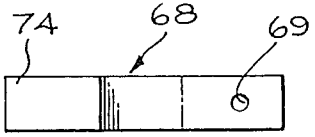
FIGS. 3A and 3B are top and side views respectively of the thermal tab of the surface unit assembly of FIG. 2 removed from the assembly to show details thereof.
Figure 3B:
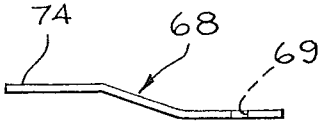

Referring again to FIG. 2, the temperature responsive means is provided in the form of a conventional limit switch designated generally 66 in combination with a tab member 68. As best seen in FIGS. 3A and 3B, tab member 68 is simply a strip of aluminum sheet metal with an aperture 69 formed at one end for mounting and a flat contact portion 74 formed at the other end thereof for thermal contact with cover member 44. Limit switch 66 includes a threaded mounting stud 70 which is inserted through a hole in bracket 62 near one end thereof and aperture 69 of tab member 68. When fully assembled, tab member 68 is secured in good thermal contact with mounting stud 70 of limit switch 66 by nut 72 on threaded stud 70. Stud 70 serves to transfer heat to the bimetallic disk thermostat (not shown) which is internal to limit switch 66. The length and angular configuration of tab member 68 is selected such that the flat surface 74 of tab member 68 is held in intimate contact with bottom surface of cover merber 44 at a contact point radially relatively remote from the periphery of the cover member.

It will be appreciated that the width and thickness dimensions for tab member 68 have been empirically derived to provide the necessary heat transfer to establish the desired relationship between the trip point oflimit switch 66 and the temperature of the glass at the periphery of the surface unit. The absolute maximum glass temperature established by the manufacturer (Schott Glass) was 536° F. This provides the theoretical upper limit for the glass. However, to provide an adequate margin of safety the nominal maximum glass temperature for the illustrative embodiment was somewhat arbitrarily set at 490° F. Thus, as an upper limit, the tab member was designed to cause limit switch 66 to trip before the temperature of the glass at the periphery exceeded 490° F. In conducting empirical tests to establish the appropriate parameters for tab member 68 a warped test pan was employed which would create a hot spot at the periphery of the surface unit directly opposite the tab contact point on cover 44. A tab configuration was chosen which caused the limit switch to trip when the temperature in the vicinity of the hot spot thus created reached approximately 490° F.

These results were obtained with a tab member made of aluminum strip 0.06 inches thick, 0.4 inches wide, and 1.8 inches long. Limit switch 66 is a standard commercially available limit switch available from E.G.O. Products Inc., identified as Type Z42 and Z43. The switch of the illustrative embodiment is rated at 10 amps, 250 volts with a nominal trip temperature of 210° C.±10° C. (410° F.±18° F.).

While the upper limit for establishing the trip point is set by the glass characteristics, it is also desirable not to adversely affect normal operation of the surface unit. In order to verify that this arrangement would not adversely affect normal operations, a full load for the cooktop was simulated by placing a cast iron plate simulating a frying pan on the right front burner set at 475° F. and placing an uncovered, flat bottom metal pan at least 4" deep, of sufficient bottom diameter to completely cover the surface unit and filled with at least 2 quarts of water, on each of the other three units. For these three surface units the power setting was adjusted to maintain a rolling boil. Empirical results established that the thermal protective configuration of the illustrative embodiment would permit operation in this simulated full-load mode for unlimited period of time without actuating the limit switch.

It will be appreciated that the specific parameters for the limit switch and tab member of the illustrative embodiment have been empirically derived to provide satisfactory results with the particular surface unit assembly and glass supporting surface of this embodiment. Adjustment of these parameters may be required to apply the invention to a different cooktop assembly.

The power circuit for surface units 12–18 will now be described with reference to FIG. 4. Surface units 12–18 are connected in parallel across power lines L1 and L2 which are adapted for connection to a 240 volt, 60 Hz AC power supply. Surface unit 14 incorporates three parallel resistive elements 82, 84 and 86. Elements 82, 84 and 86 are rated at 625 watts, 250 watts and 625 watts respectively. Internal limit switch 88 is connected between elements 82 and 84. Limit switch 88 is contained between plate 30 and cover member 44 and responds directly to the temperature of metal plate 30. Switch 88 is operative to decouple elements 84 and 86 from the power circuit when the temperature of metal plate 30 exceeds 900° F. as hereinbefore described.

Power to element 14 is selectively controlled by user adjustable infinite heat switch designated generally 90. Switch 90 is mechanically coupled to control knob 24 in conventional fashion (not shown). Contact 92 is moved to its closed position whenever control knob 24 is rotated from its off position to a non-off position and is in its open position whenever control knob 24 is in its off position. A bimetal element, schematically represented at 94, cycles contact 96 open and closed with a duty cycle established by the positioning of control knob 24 in conventional fashion. Diode 98 limits the current through element 94 for power settings 5 and above. Shunt switch 100 remains in a closed position shunting shorting diode 98 out of the circuit when the control knob is set at any power setting less than 5 including off. This diode and shunt switch arrangement permits greater resolution for power level selection at the lower power settings.

Switching contacts 104 oflimit switch 66 are connected between L1 and resistive elements 82, 84 and 86. Switch 66 is operative to open contacts 104 when its trip temperature of 210°±10° C. is exceeded, thereby interrupting power to the surface unit resistive elements.

The circuitry for surface unit 16 is essentially identical to that of surface unit 14 except that elements 106, 108 and 110 are rated at 850 watts, 300 watts and 850 watts respectively, and the bimetal switch of infinite heat switch 90 in this portion of the circuit is adjusted by user manipulation of control knob 26.

The power circuits for automatic surface units 12 and 18 are also similar; however, these units do not include an internal limit switch responsive to the surface unit temperature, since power is controlled by temperature sensors responsive to the temperature of utensils being heated. Referring first to the circuit for surface unit 18, resistive elements 114 and 116, each rated at 750 watts, are connected in parallel across L1 and L2 via control switch 118 and limit switch 66. Control switch 118 includes on/off switch contact 120, and thermostat controlled contacts 122 and 124, the set points for which are set by user manipulation of control knob 28. Contacts 120 are closed whenever knob 28 is rotated from its off position. Contact 122 connected in series with element 116, opens when the set point temperature is reached. Contact 124 connected in series with element 114 cycles to hold the set point temperature.

Surface unit 12 is heated by elements 126, 128 and 130. 126 and 128 are cumulatively rated at 1000 watts and element 130 is rated at 1000 watts. Contact 122 opens upon reaching the set point temperature; contact 124 cycles to hold this temperature. The set points for contacts 122 and 124 in this branch of the circuit are set by user manipulation of control knob 22.

This control circuitry is conventional except for the inclusion of a limit switch 66 for each surface unit, and it will be appreciated that other power control arrangements could be similarly employed.

It will be apparent from the foregoing that the present invention provides an improved cost effective, easily implemented thermal protection arrangement for solid disk surface units mounted in glass support surfaces which protects the glass against damage resulting from hot spots around the peripery of the surface unit while at the same time not interfering with normal operation of the unit.

While in accordance with the Patent Statutes a specific embodiment of the invention has been illustrated and described herein, it is realized that numerous modifications and changes will occur to those skilled in the art. For example, in the circuit of the illustrative embodiment the limit switch is connected in the circuit so as to totally decouple the entire surface unit from the circuit. However, other multi-element surface unit configurations are possible in which each resistive element may have its own set of external terminals for connection to the power lines, in which case the limit switch could be connected so as to de-energize one or more but not necessarily all of the resistive elements for the surface unit so as to limit the power to the unit to a level that would not cause damage without totally de-energizing the unit so as to permit continued heating of the unit at a reduced level. It is therefore to be understood that the appended claims are intended to cover all such modifications and changes as fall within the true spirit and scope of the invention.

What is claimed is:

1. In a cooking appliance of the type having at least one surface unit mounted in an opening in a support surface of glass or ceramic material, each surface unit comprising a plate member having an upper surface providing a generally planar heating surface, at least one resistive heating element mounted to the underside of the plate member and adapted for energization by an external power supply, and a thermally conductive cover member extending over the underside of the plate member enclosing the resistive element therebetween, the peripheral edges of the cover member being in close thermal contact with the underside of the plate member near its peripheral edge, the improvement comprising means thermally responsive to the surface temperature of the cover member at a location on the surface of the cover member relatively remote from the peripheral edges of the cover member said surface temperature being indicative of the temperature of the plate member near its peripheral edge, said thermally responsive means being operative to disconnect the resistive element from the power supply when the surface temperature of the cover member at said location exceeds a predetermined threshold temperature selected so as to limit the temperature at the periphery of the surface unit to a temperature less than the annealing temperature of the glass or ceramic material comprising the surrounding support surface whereby the support surface is protected against damage resulting from hot spots occurring around the periphery of the surface unit.

2. The improvement of claim 1 wherein said thermally responsive means comprises a thermally conductive tab member having one end in close thermal contact with the cover member at said remote location and a temperature limit switch having contacts serially connecting the surface unit resistive element and the external power supply, said switch means being thermally responsive to the temperature of the other end of said tab member, the configuration of said tab member, and said switch set point temperature being selected such that said switch is operative to disconnect the resistive element from the power supply when the temperature of said one end of said tab member exceeds said predetermined threshold temperature whereby the support surface is protected against damage resulting from hot spots occurring around the periphery of the surface unit.

3. The improvement of claim 2 wherein said predetermined threshold temperature is selected to be greater than the maximum temperature associated with the normal operating conditions of the unit whereby damage to the glass is prevented without interfering with normal cooking operations.

4. The improvement of claim 2 wherein said tab member comprises an aluminum strip approxiaately 0.06 inches thick, and 0.4 inches wide.

5. The improvement of claim 4 wherein said limit switch means has a set point in the range of 190°-220° C.

6. In a cooking appliance of the type having at least one surface unit mounted in an opening in a support surface comprised of a glass or ceramic material, each surface unit comprising a plate member having an upper surface providing a generally planar closed cooking surface, at least one resistive heating element mounted to the underside of the plate member and adapted for energization by an external power supply, and a thermally conductive cover member extending over the underside of the plate member, the peripheral edges of the cover member being in close thermal contact with the underside of the plate member, a thermal protection arrangement comprising:

a thermally conductive tab member having one end in close thermal contact with said cover member at a location relatively remote from the peripheral edges of the cover member; and thermally responsive switch means having contacts serially connecting the surface unit resistive element and the external power supply, said switch means being thermally responsive to the temperature of the other end of said tab member which is indicative of the temperature at the peripheral edge of said cover member, said thermally responsive switch means being operative to disconnect the resistive element from the power supply when the temperature of said other end of said tab member exceeds a predetermined trip point temperature, the geometrical configuration of said tab member and the value of said predetermined trip point temperature being selected to limit the temperature at the periphery of the surface unit to a temperature less than annealing temperature for the glass or ceramic material comprising the support surface, whereby the glass support surface is protected against damage resulting from hot spots around the periphery of the surface unit.

7. The thermal protection arrangement of claim 6 wherein said predetermined trip point temperature is greater than the maximum temperature associated with normal operating conditions whereby damage to the support surface is prevented without interfering with normal cooking operations.

8. The thermal protection arrangement of claim 6 wherein the surface unit is retained in an opening in the glass cooktop by a bracket member formed substantially of an inverted U-shaped channel which extends beneath the surface unit and spans the opening in the glass, and wherein said switch means is mounted to said channel member near one end thereof with said tab member extending from said switch means to said cover member.

9. The protective arrangement of claim 6 wherein said tab member comprises an aluminum strip approximately 0.06 inches thick, and 0.4 inches wide.

10. The thermal protection arrangement of claim 9 wherein said switch means comprises a limit switch having a set point in the range of 190°-220° C.

11. A surface unit assembly for mounting in a mounting plate comprised of a glass or ceramic material having mounting openings therein, said surface unit assembly comprising:

a plate member having an upper surface providing a generally planar heating surface;

at least one resistive heating element mounted to the underside of said plate member and adapted for energization by an external power supply;

a thermally conductive cover member extending over the underside of said plate member and enclosing said resistive element therebetween, the peripheral edges of said cover member being in close thermal contact with the underside of said plate member near its peripheral edge; and means thermally responsive to the surface temperature of said cover member at a contact point relatively remote from said peripheral edges of said cover member said surface temperature being indicative of the temperature of said plate member near its peripheral edge, said thermally responsive means being operative to disconnect said resistive element from the external power supply when the surface temperature of said cover member at said contact point exceeds a predetermined threshold temperature selected so as to limit the temperature at the periphery of said surface unit to a temperature less than the annealing temperature of the glass or ceramic material comprising the support surface whereby the support surface is protected against damage resulting from hot spots occurring around the periphery of said surface unit.

12. The surface unit assembly of claim 11 wherein said means thermally responsive to the surface temperature of said cover member comprises a thermally conductive tab member having one end in close thermal contact with said cover member at said contact point, and a temperature limit switch having contacts adapted to serially connect said resistive element to the external power supply, said temperature limit switch being thermally responsive to the other end of said tab member, the configuration of said tab member and said limit switch set point temperature being selected such that said switch is operative to disconnect said resistive element from the power supply when the temperature of said one end of said tab member exceeds said predetermined threshold temperature whereby the support surface is protected against damage resulting from hot spots occurring around the periphery of the surface unit.

13. The surface unit assembly of claim 12 wherein said predetermined threshold temperature is further selected to be greater than the maximum temperature associated with the normal operating conditions of said surface unit whereby damage to the support surface is prevented without interfering with normal cooking operations.

14. The surface unit assembly of claim 13 further comprising a bracket member formed substantially of an inverted U-shaped channel adapted to extend beneath said plate member spanning the opening in the support surface and adapted to be secured to said plate member to retain said surface unit assembly in the cooktop opening and wherein said switch means is mounted to said bracket member near one end thereof with said tab member extending from said switch means to said cover member.

15. The surface unit assembly of claim 14 wherein said tab member comprises an aluminum strip approximately 0.06 inches thick and 0.4 inches wide.

16. The surface unit assembly of claim 15 wherein said limit switch set point is in the range of 190°–220° C.

* * * * *